United States Patent [19]

Yanes

[11] Patent Number: 4,491,244

[45] Date of Patent: Jan. 1, 1985

[54] PORTABLE COOLABLE BEVERAGE DISPENSER

[76] Inventor: Ralph S. Yanes, 1015 W. Verdugo Ave., Burbank, Calif. 91506

[21] Appl. No.: 514,665

[22] Filed: Jul. 18, 1983

[51] Int. Cl.[3] ..... B67B 7/28

[52] U.S. Cl. ..... 222/88; 222/105; 222/146.6

[58] Field of Search ..... 222/105, 146 C, 83, 222/83.5, 81, 88, 91, 80

[56] References Cited

U.S. PATENT DOCUMENTS

| | | | |
|---|---|---|---|
| 3,081,911 | 3/1963 | Scholle | 222/105 X |
| 3,977,569 | 8/1976 | Scholle | 222/105 |
| 4,316,555 | 2/1982 | Smith | 222/83.5 |

*Primary Examiner*—Stanley H. Tollberg
*Attorney, Agent, or Firm*—Frank L. Zugelter

[57] ABSTRACT

A portable coolable beverage or liquid dispenser made of insulating material forming a base unit, shell and cap, all joined to form a chamber in which a pliant or ductile beverage-containing vessel is mounted on and partially supported by a container having a reservoir which captures the vessel's beverage after the latter's release therefrom. Such release occurs in the assembly for use of the dispenser, as a portion of the vessel's skin within a threaded collar connected to such skin is punctured by a tip on a sleeve extending through a threaded opening in the container's lid. The lid's opening and the vessel's collar are secured together prior to closure of the container by its lid. The container's reservoir is sealed by such lid closure to avoid contamination of the beverage. Spacial dimensions about the vessel and container provide for introduction of ice into the chamber, and a passageway from the reservoir to an external spigot provides the manner of dispensing the liquid. A hand lift and a drain outlet for the dispenser are included.

9 Claims, 7 Drawing Figures

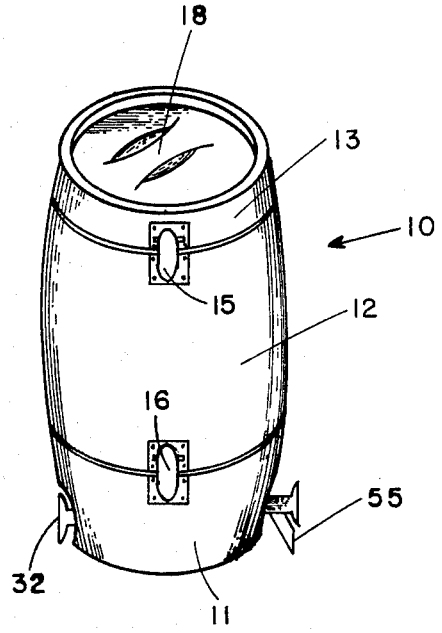
FIG. 1.
FIG. 3.
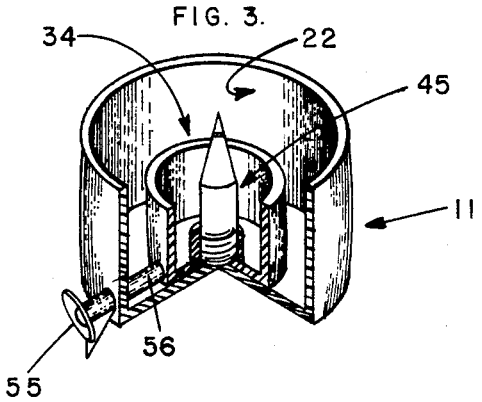
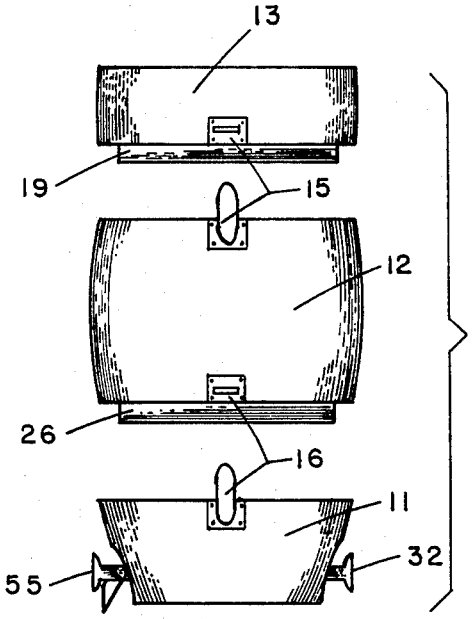
FIG. 2.
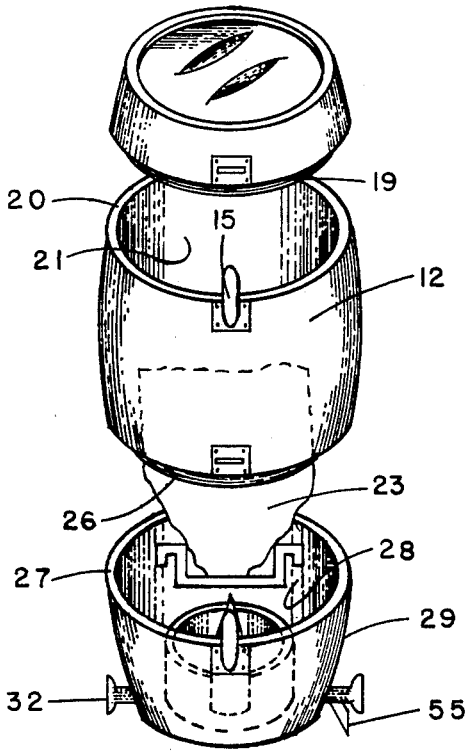
FIG. 4.

PORTABLE COOLABLE BEVERAGE DISPENSER

TECHNICAL FIELD

This invention is directed to a portable beverage dispenser, and in particular to a dispenser dispensing a captured beverage after it has been released from a pre-fabricated pliant or ductile metallic vessel.

BACKGROUND ART

The disclosures of U.S. Pat. Nos. 398,446; 1,289,560; 1,781,035; 2,058,027; 2,509,562; and 3,933,275 show various kinds of beverage or liquid dispensers.

DISCLOSURE OF THE INVENTION

The invention encompasses a construction of a portable dispenser having automatic means for releasing a beverage from a pliant pre-fabricated metallic or skin-like vessel and into a reservoir where it is captured and from which it is dispensed exteriorly to the dispenser, while maintaining a suitable degree of coolness for the vessel and reservoir, by means of ice cubes or the like, and also having means for preventing contamination of the beverage by ingress of melting or melted ice into the reservoir capturing the beverage.

Further, the utilization of the pliant or ductile metallic vessel in a cooling environment other than a refrigerator requires a means in the dispenser to displace liquid or beverage from such a vessel into itself while the liquid is being cooled, and still not contaminate the liquid during or after such displacement, but before dispensing the liquid from the dispenser apparatus.

The construction also includes various features by which it can be assembled and disassembled readily, easily and quickly. It is made of light weight materials which facillitates the portability of the dispenser.

One innovation which has developed commercially recently is the provision of a metallic or skin-like vessel filled with a beverage, such as wine, for example, and having a small plastic stop-cock or valve operatively connected to the skin near, say , its lower bottom. The vessel completely fills the spatial dimensions of an elongated cardboard carton having a suitable hole in the lower portion of one of its vertically-disposed sides and out of which the stop-cock can emerge and be manually actuated. This entire assembly is refrigeratable, and its beverage, whether cooled or not, is quickly dispensed by manual operation of the stop-cock.

However, where such a pliant vessel is to be located in a cooling environment other than refrigerator, particularly outdoors, the matter of providing a dispenser construction suitable for maintaining coolness for such a vessel arises; one in which the coolant, such as chopped or cubed ice, maintains a desired degree of coolness; while at the same time, preventing contamination by such ice or its melted condition (water) which is retained in the dispenser for periods of time intermediate drainage occurrences for the water from the dispenser.

This invention solves these noted problems while concurrently providing the advantages of coolness and a non-contaminated condition for the beverage while it remains within the dispenser apparatus.

An object of the invention is to provide a novel, improved construction in a portable beverage dispenser.

A further object of this invention is to maintain a sanitary or non-contaminated condition for the beverage being retained in the dispenser prior to it being dispensed therefrom thus eliminating the possibility of contamination prior to such dispensing.

Another object of this invention is to provide an efficient, quick and safe assembly of a pre-fabricated, pliant, metallic or skin-like vessel full of beverage to the dispenser without spillage or contamination as the assembly progresses and its use materializes.

A still further object of this invention is to provide an inexpensive yet sturdy dispenser reuseable again and again over a considerably long life.

These and other objects and advantages will become more apparent upon a full and complete reading of the following description, appended claims thereto, and the accompanying drawing comprising two sheets.

BRIEF DESCRIPTION OF THE DRAWING

FIG. 1 is a perspective view of an embodiment of the invention.

FIG. 2 is an exploded elevational view of the embodiment of FIG. 1.

FIG. 3 is a cut-away perspective view of the base unit in the embodiment of FIG. 1 and FIG. 2.

FIG. 4 is an exploded perspective of the invention, showing some elements of the subject matter of the invention in phantom.

BEST MODE FOR CARRYING OUT THE INVENTION

Figure 5:
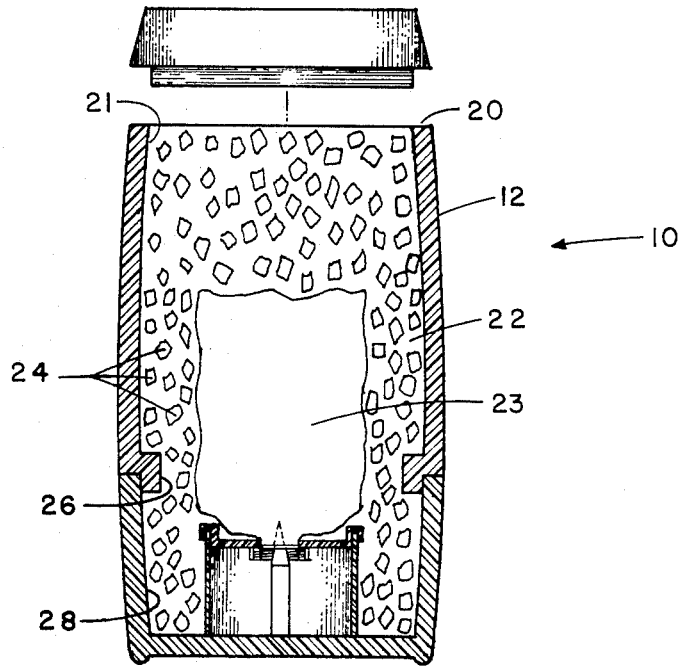
FIG. 5 is an elevational, partly-sectional view of the embodiment of actual use.

Referring now to the drawing wherein reference characters correspond to like numerals hereinafter, character 10 denotes a portable beverage dispenser. Dispenser 10 comprises, FIG. 1, a base unit 11 to which is mounted a shell 12 capable of being closed by a cover or cap 13.

Pairs of suitable clip devices 15,16, FIGS. 1,2, are provided for securing the cover 13 to the shell 12 and shell 12 to the base unit 11, respectively. Any suitable and known clip device for closing upon itself may be utilized as one of the clip pairs 15,16, such a device being securely mounted in known fashion to the walls forming the elements 11,12, and 13, and as shown in FIGS. 1,2.

Cover 13 is preferably circular in nature and includes a handle or hand lift 18 which is preferably integrally formed with it. A somewhat smaller circular base 19, FIGS. 2,4, is formed at the bottom of cover 13 to engage and mount upon, in a press-fit or snug manner, the circularity of an edge 20, FIG. 4, and inner surface 21, FIGS. 4,5, of the wall forming shell 12, so that cover 13 closes off the top of shell 12 when mounted thereon, and after which each of clip pairs 15 can positively engage itself to secure together these two elements 12,13.

Figure 7:
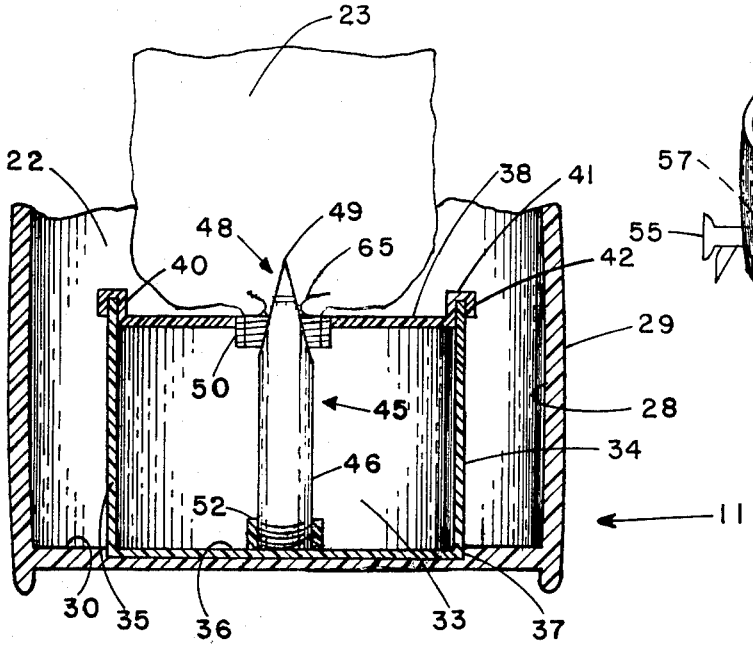
FIG. 7 is an elevational, partly-sectional, fragmentary view of the base unit and interiorly disposed elements of the embodiment.

The shell 12 is formed in a generally cylindrically-shaped or barrel-shaped manner, to thereby provide for a portion of a chamber 22, FIGS. 5,7, which is utilized for disposition of a pliant beverage vessel 23 and cubed or chopped ice 24, FIG. 5, in actual use for dispenser 10. At the bottom of shell 12, annular ring or boss 26, FIGS. 4,5, of somewhat smaller dimension is formed so as to engage and mount upon, in a press-fit or snug manner, the circularity of an edge 27, FIG. 4, and wall inner surface 28 forming base unit 11, thereby joining shell 12 and base unit 11, and thereby forming chamber 22. Thereafter, each of clip pairs 16 can positively engage itself to secure together these two elements 11,12.

Figure 6:
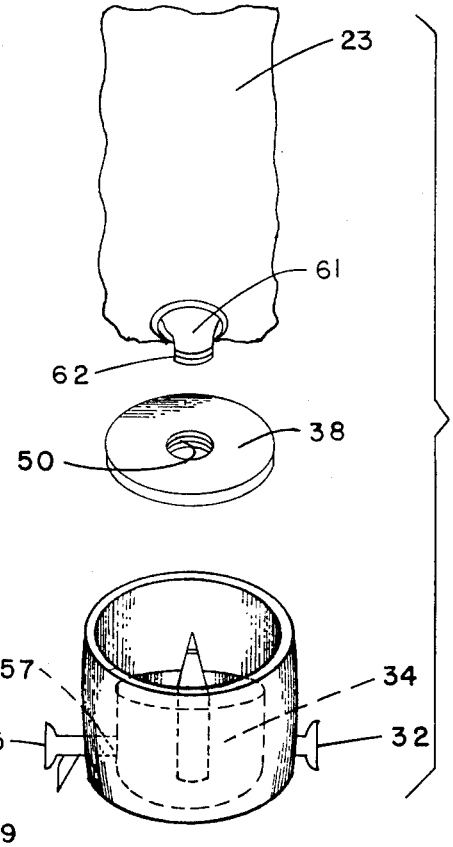
FIG. 6 is an exploded perspective view showing interiorly disposed elements of the embodiment.

The base unit 11 is formed of material like that for cover 13 and shell 12 and comprises a generally upraised circular member 29, FIG. 7, which includes the wall forming surface 28, and a horizontally disposed floor 30 fixed to member 29. A suitable drain valve or plug 32, FIGS. 1,2,6, is conventionally attached to and through member 29 immediately above the level of floor 30 for withdrawing water that accumulates in base unit 11 from melting or melted ice used in the operation of the invention.

A reservoir 33, FIG. 7, for captured beverage is provided within base unit 11, spaced from the rising wall 29 of base unit 11, and comprises a container 34, preferably circular, secured, preferably centrally of, to floor 30 by any suitable means, such as for example, by a press-fit of the exterior surfaces of its wall 35 and base 36 into recess 37, FIG. 7, provided in the structure floor 30. Sealing means for reservoir 33, such as a lid 38, is mounted at the container's open end upon its wall 35, and includes a vertically-disposed wall element 40, a horizontally disposed flange 41 formed to wall element 41, and a lip 42 depending from flange 41, all preferably formed as integral components of lid 38. In the mounting of lid 38 to container 34, its elements 40,41, and 42 cooperate with wall 35, FIG. 7, so as to seal reservoir 33 from chamber 22 and anything that may be in the latter, such as ice, water, pollutants, contaminants, etc.

It is now apparent that spacial dimensions within chamber 22 provide for introduction of ice 24 about and around vessel 23, deposited in assembly in chamber 22, and about and around container 34, whereby cooling of a beverage or liquid contained in such elements 23,34 is achieved.

An actuator 45, FIGS. 3,7, is securely mounted at its one end within and to container 34 and disposed therein in an ascending manner, and comprises a rigid sleeve 46 and a cutting means 48, such as a pointed tip 49 mounted at its other end. Actuator 45 extends through or projects out of a threaded opening 50 in lid 38. Sleeve 46 is secured to the base of container 34, such as by threading its lower end to a threaded upraised collar 52 formed in base 36 of container 34, and preferably is of a hollow configuration.

An external spigot 55, FIGS. 1–3,6, preferably located in a blind recess in base unit 11, is attached to a tube 56, FIG. 3, or the like, constituting an isolated passageway 57, FIG. 6, for egress of beverage from container 34 to the exterior of dispenser 10, without the beverage invading chamber 22. Tube 56 is suitably attached at its one end to the container's wall 35 adjacent its base 36; while its other end is suitably attached to spigot 55. Thus, passageway 57 extends through chamber 22 formed in dispenser 10, yet being totally isolated or separated therefrom.

Means for channelling a supply of beverage into lid opening 50 is secured to vessel 23. For example, FIG. 6, a neck 61 is securely mounted to vessel 23 in known manner without breaking the pliant or ductile skin of vessel 23. A threaded collar 62 is formed on neck 61 to cooperate with the body formation forming threaded opening 50 in lid 38 during the assembly for use of dispenser 10. Vessel 23 is of a metallic pliant nature, which is available today in the marketplace. Generally speaking, vessel 23 is made of generally rectangular or straight-edged foil or sheet members the edges of which are joined and heat sealed together so that vessel 23 is constructed for retaining liquid therein.

The channelling means is made of suitable plastic material, and is operatively connected in known fashion to one of the metallic sheets forming vessel 23, preferably adjacent one of its edges, FIG. 6, forming its width, for use in this invention. It is important to note that the securing application of the channelling means to a portion 65 (shown broken, FIG. 7) of a vessel 23 does not puncture portion 65, and such an application thereof to a metallic sheet, such as made out of aluminum, is presently known in the art.

In the assembly and use or operation of the invention, container 34 is mounted in place in recess 37 of floor 30 of base unit 11, FIGS. 5,7. Tube 56 is suitably connected in known manner between container 34 and spigot 55 mounted exteriorly of wall 28. Actuator 45 is threaded into its collar 52, its cutting means 48 extending upwardly. Lid 38 is threadedly attached to the channelling means or threaded collar 62 of vessel 23. At this step in assembly, one may prefer to set shell 12 in place on base unit 11, before lid 38 is slipped onto the container's wall 35. On the other hand, lid 38 with vessel 23 attached to it may be slipped onto the wall 35 of container 34 before combining the shell 12 and base unit 11. Whichever step is used firstly or secondly, as lid 38 is slipped into place on the container's wall 35, tip 49 of actuator 45 pierces or slices through portion 65 of the metallic skin of vessel 23, within the confines of the dimensions of the channelling means or collar 62 secured to such skin of vessel 23. A supply of the beverage in vessel 23 is released by such action to flow into reservoir 33 of sealed container 34 which captures such supply, until the latter is filled.

Cubed or chopped ice is then added to chamber 22 formed by the joined shell 12 and base unit 11, filling chamber 22 around reservoir 33 and vessel 23, FIG. 5.

Thereafter, cover 13 is seated in place on the top of shell 12. The pairs of clips 15,16 are then closed on their repective selves, so as to form a singular, composite or one-piece dispenser 10 that can be conveniently portably carried by the hand lift 18.

Manual actuator of spigot 55 dispenses cooled beverage through passageway 57 from reservoir 33, while drain value or plug 32 provides removal of water accumulating in chamber 22.

It is to be noted that dispenser 10 is operable whether vessel 23 is or is not under pressurization, such as by the carbonation of the beverage as it is sealed within vessel 23 in accordance with current manufacturing and fabrication practices. Where self-venting is involved, spigot 55 and passageway 57 are each of a size to provide the flow of ambient air therethrough and into reservoir 33 and into vessel 23, when there would be a partial vacuum in vessel 23, so as to provide venting of vessel 23 and reservoir 33 when dispenser 20 is in use and while liquid or beverage is flowing out of spigot 55.

It is to be noted that my inventive concept comprehends as well the use of a hollow sleeve 46 of a dimension the same as opening 50 in lid 38. In this case, one or more apertures (not shown in drawing) are provided, at one or more levels, in sleeve 46 and its tip portion in order that liquid in vessel 23 flows into reservoir 33 of container 34.

The various elements described above are formed of known materials, and by known manufacturing and fabricating processes. Cap 13, shell 12 and base unit 11 preferably are fabricated of insulating material, lightweight in nature. Each of clips 15,16 may be made of metal. Metallic vessel 23 with plastic neck 61 and threaded collar 62 are pre-fabricated. Container 34 and lid 38, with or without their attendant features described above, may be molded from plastic materials. Hollow sleeve 45 may be made of suitable plastic providing the characteristic of rigidity, as its tip 49 will be repeatedly used to slice the metallic skin of vessel 23. Or tip 49 may be made of metal.

The spigot 55 and drain valve or plug 32 are formed of plastic in known manner.

What I claim as patentably distinct is:

1. A portable dispensing manufacture for maintaining coolness of a liquid in and from a pliant liquid-containing vessel adapted for mounting within the manufacture and comprising a base unit having a floor from which wall means rise upwardly therefrom and a shell connectable to the wall means to form a single chamber with said base unit within the manufacture, a container constituting a reservoir for the vessel's liquid securely mounted to the base unit's floor and having wall means spaced from the wall means forming the single chamber to provide spatial dimensions between the wall means forming the single chamber and the container, a lid mounted on said container for sealing its reservoir, means for connecting a pliant liquid-containing vessel to said container mounted in said lid, an actuator disposed within said connecting means and including a piercing element disposed above the level of said lid for cutting open the liquid-containing vessel adapted for mounting and securing to said connecting means, a spigot or the like exteriorly mounted on the base unit's wall means, and means forming a passageway mounted between the reservoir and the spigot or the like in the spatial dimensions provided between the wall means of both container and base unit, whereby ice or the like can be disposed in the single chamber in such spatial dimensions about and around said container from the base unit's floor to and through said shell and about such liquid-containing vessel connected to said lid, the vessel releasing a supply of liquid into the container's reservoir by the piercing action of said actuator to maintain coolness in the liquid until dispensed from the reservoir through the passageway and spigot or the like.

2. The manufacture of claim 1 including a cap mounted on said shell.

3. The manufacture of claim 1 wherein said actuator comprises a sleeve securely mounted in said container and extending upwardly through said connecting means, and a cutting tip on said sleeve constituting the piercing element disposed above said lid.

4. The manufacture of claim 2 wherein said actuator comprises a sleeve securely mounted in said container and extending upwardly through said connecting means, and a cutting tip on said sleeve constituting the piercing element disposed above said lid.

5. The manufacture of claim 4 including a pliant liquid-containing vessel having dimensions substantially less than those of said base unit and shell wall means and being mounted in the single chamber on said lid and having channelling means secured to an unbroken portion thereof, said channelling means being attached to said connecting means, such attachment causing said cutting tip to break such unbroken portion thereby releasing a supply of liquid from the vessel into the reservoir.

6. The manufacture of claim 5 wherein said channelling means comprises a neck and a threaded collar, said collar attachable to said connecting means.

7. The manufacture of claim 3 including a pliant liquid-containing vessel having dimensions substantially less than those of said base unit and shell wall means and being mounted in the single chamber on said lid and having channelling means secured to an unbroken portion thereof, said channelling means being attached to said connecting means, such attachment causing said cutting tip to break such unbroken portion thereby releasing a supply of liquid from the vessel into the reservoir.

8. The manufacture of claim 7 wherein said channelling means comprises a neck and a threaded collar, said collar attachable to said connecting means.

9. The manufacture of claim 8 including a cap mounted on said shell.

* * * * *